US005554392A

United States Patent [19]

Gray

[11] Patent Number: 5,554,392

[45] Date of Patent: Sep. 10, 1996

[54] APPARATUS FOR FORMING WALLS

[76] Inventor: Leroy D. Gray, 1760 Ferry Ave., SW., Seattle, Wash. 98116

[21] Appl. No.: 424,551

[22] Filed: Apr. 17, 1995

Related U.S. Application Data

[63] Continuation of Ser. No. 45,418, Apr. 9, 1993, abandoned.

[51] Int. Cl.[6] ..... B28B 1/08; E04G 21/06; E04G 11/22

[52] U.S. Cl. ..... 425/64; 249/10; 249/15; 249/20; 425/145; 425/150; 425/431

[58] Field of Search ..... 264/33, 35, 333, 264/69, 70; 249/20, 15, 10; 425/63, 64, 140, 145, 150, 431

[56] References Cited

U.S. PATENT DOCUMENTS

| | | | |
|---|---|---|---|
| 789,988 | 5/1905 | Metcalf | 264/33 |
| 834,253 | 10/1906 | Bieber . | |
| 943,991 | 12/1909 | Nelson . | |
| 947,160 | 1/1910 | Newerf . | |
| 1.030,480 | 6/1912 | Packard . | |
| 1,122,982 | 12/1914 | Mumford . | |
| 2,150,830 | 3/1939 | Hallisg | 264/33 |
| 2,187,223 | 1/1940 | Cory | 264/33 |
| 2,516,318 | 7/1950 | Hawes | 425/63 |
| 2,562,403 | 7/1951 | Ahart | 249/20 |
| 2,620,543 | 12/1952 | Scharsach | 25/131 |
| 2,706,842 | 4/1955 | Keffer | 425/63 |
| 2,723,437 | 11/1955 | Ghormley et al. | 249/20 |
| 3,034,732 | 5/1962 | Winn, Jr. | 264/33 |
| 3,039,164 | 6/1962 | Kemeny et al. | 25/104.5 |
| 3,618,181 | 11/1971 | Veale | 249/20 |
| 3,628,223 | 12/1971 | Babee | 425/65 |
| 3,754,066 | 8/1973 | Black | 264/71 |
| 3,991,842 | 11/1976 | Larsen | 425/64 |
| 4,076,778 | 2/1978 | Whitting | 264/33 |
| 4,128,610 | 12/1978 | Ahlgren | 264/33 |
| 4,374,790 | 1/1983 | McGowan | 264/333 |
| 4,799,872 | 1/1989 | Dowdle | 425/63 |
| 4,917,587 | 4/1990 | Alpar et al. | 425/64 |

FOREIGN PATENT DOCUMENTS

| | | | |
|---|---|---|---|
| 64183 | 11/1982 | European Pat. Off. | 249/20 |
| 2318289 | 3/1977 | France | 425/63 |
| 2053518 | 5/1971 | Germany | 425/64 |
| 2509906 | 9/1976 | Germany | 425/63 |
| 2748742 | 8/1978 | Germany | 425/63 |
| 711255 | 1/1980 | U.S.S.R. | 425/63 |
| 1708662 | 1/1992 | U.S.S.R. | 264/33 |

OTHER PUBLICATIONS

M. K. Hurd, *Formwork for Concrete* , 1973, pp. 281–292, Pub. 4, Amer. Concrete Inst.

*Primary Examiner*—Karen Aftergut
*Attorney, Agent, or Firm*—Ward & Olivo

[57] ABSTRACT

The invention relates to an improved apparatus for the production of substantially vertical walls, and specifically, walls made of concrete which includes a single sided concrete form used, for example, to form a concrete wall against a preexisting wall or embankment, by pumping concrete into a gap between the form and the preexisting wall or embankment, and raising the form vertically as the pumped concrete settles and drys. The apparatus enables the construction of vertical walls of superior strength in less time as compared to currently available systems.

11 Claims, 5 Drawing Sheets

APPARATUS FOR FORMING WALLS

This is a continuation of application Ser. No. 08/045,418, filed Apr. 9, 1993, now abandoned.

FIELD OF THE INVENTION

The invention is related to a method and apparatus for forming substantially vertical walls by using a single travelling forming member, which travels along substantially vertical rails. As the single travelling forming member travels upward, a concrete wall is extruded from concrete pumped between a base wall and the single travelling forming member.

BACKGROUND OF THE INVENTION

In the formation of substantially vertical concrete structures, it is well known in the art to use forms, usually made of wood, for molding concrete. Traditionally, the wooden forms are constructed with interior dimensions and shapes exactly equal to the concrete wall to be poured and formed within. That is, once the poured concrete fills the form, it is left to dry, and with the form removed, the concrete will remain in the desired form. Such wooden forms must be constructed with substantially durable and heavy gauge plywood, so that the intense pressure (due to the heavy weight of concrete) pent-up within the form is contained. Such wooden forms are routinely constructed at great expense, and require a great deal of skill to set up and disassemble once the concrete is dry. Furthermore, upon disassembling the forms, it is common that parts of the interior hardened concrete can become damaged if the form is not carefully and properly removed.

Many other shortcomings exist with the use of traditional forms that are assembled like boxes. "Box" forms must be constructed with all sides in place, thus leading to relatively high material costs for constructing forms generally. Also, because overall construction costs are generally driven by time constraints, the additional time required for assembling, placing and disassembling box forms results in substantial costs and diminished productivity.

When relatively high and narrow concrete structures are formed with correspondingly high and narrow box forms (for example, a ten foot (10') high by four inch (4") wide wall), other problems can result from the lack of access to the area in which the concrete is being poured. For example, if in the case of pouring a 10' high by 4" wide wall, a cement mixer fails, pouring must be halted. This can happen even though the wall formation may only be barely underway. In this event, although iron support rods or rebar will provide support between the wall segments which were poured at separate times, it is desirable to install a water barrier between the two wall segments. For this purpose, water barriers or "water stops" are often partially placed into the upper most surface of the recently poured, wet concrete. Then, when pouring is recommenced, the protruding portion of the water stop protrudes into the next segment of the concrete wall that is being poured. Such water barriers are often made of rubber or some type of polymer, and are generally desirable whenever an unexpected "cold joint" occurs. Unexpected cold joints are common in the practice of pouring concrete walls, but the insertion of water barriers is often not possible. For example, in the case of deep and narrow box forms, it is often impossible to have access to the uppermost surface of the freshly poured concrete, as it could be several feet down into the form. Thus, box forms have many shortcomings.

One way to avoid the use of box forms is through the use of "slip-type" forms, as described by M. K. Hurd, *Formwork For Concrete*, published by the American Concrete Institute in 1973. In the article, a special technique for concrete construction is set forth, using a slip form. The major advantages of such slip forms are speed and cost. With respect to slip forms used to create substantially vertical walls, two opposing forms traditionally travel along the vertical length of rails to form a vertical concrete wall between the two forms. The two opposing forms travel continuously upward as the concrete is inserted between them. This type of slip form, that is, the two-sided slip form, can only be used where few projectiles traverse the sliding direction, if not, one of the two sliding members could become impacted against the protruding projectiles.

Another problem with traditional two-sided slip forms entails the cost of constructing two separate form-slider mechanisms. That is, two redundant forms each associated with sets of rails must be constructed, one form and set of rails for each side of a wall to be formed. Also, where an embankment or wall is already existent (that is, a so-called "base wall" exists), it is most desirable to form concrete walls against such base walls. That is, when a two-sided form is used to construct a vertical wall, the newly formed wall must necessarily be bolted or otherwise fastened to the previously existent base wall. Such bolts require that holes be drilled through both adjacent walls, so they can be fastened together. The bolt holes can lead to water or thermal leakage. Also, over periods of time, such bolts can become corroded, thus affecting the structural integrity of the overall wall. By forming a concrete wall against a base wall, the two walls, in effect, would become fused together, since the wall being formed drys as it is pressed up against the base wall, leading to a sealed (air and water tight) unit when the poured wall dries. If a two-sided slip form is used, such an arrangement is impossible, since one side of the two-sided form will always be present between the existent walls or embankments (base walls) and the newly formed wall.

Another problem with two-sided slip forms is that the two forms must be positioned opposed to each other, and able to withstand intense pressure, resulting in higher construction costs.

Finally, with respect to positioning concrete against existent or base walls, care must be taken not to cause loose dirt or gravel to slide into the concrete mix. That is, if the ground above the drop-off of an embankment is disturbed, loose dirt or gravel may enter the area where the concrete is to be formed, causing impurities to enter the concrete wall. For example, if a cement mixer is positioned immediately above a gravel embankment, there could be a tendency to cause loose gravel to fall into the area below where the concrete is to be poured and formed. Although a two-sided form can help prevent this occurrence (one side of that type of form lies between the forming area and the embankment), constructing a one-sided forming system would be especially susceptible to gravel contamination, where concrete is placed into the forming area directly by a concrete truck or workers by shovel who are positioned at the rim of the embankment.

Other problems exist in construction with traditional concrete wall forming techniques. Slip forms, for example, are often over sized to accommodate a maximum amount of concrete at any given instant in time. This often leads to protracted setting and drying times. Also, when concrete is manually shoveled into a form, it is often first dropped (often from a shovel and wheel-barrow) onto a sheet of plywood adjacent to the opening in a wooden form, before ultimately being shoveled into the concrete forming area within the form. Problems have been experienced in this regard, however, because the cement and water often separate from the gravel (or rocks), thus sacrificing concrete strength and quality. This is often the case, even where traditional slip-forming is used, because slow concrete delivery systems (e.g., by hand) cannot keep up with the forming process.

Overpouring into the slip forms, also problematic, results in not being able to move the slip form upward in time before the freshly poured concrete begins to adhere to the form. Generally, the more concrete that is poured against the forms, the more difficult it is to move the forms, due to frictional forces.

SUMMARY OF THE INVENTION

The present invention drastically improves conventional sliding form construction. First, slip forms, traditionally consisting of two opposing form sides, are constructed with but a single traveling form, or a "one-sided" slip form. The one-sided horizontally positioned slip form is disposed across at least two substantially vertically positioned support beams, which are firmly anchored in place into or upon the ground, with the help of lateral supports well known in the art if desired. The one-sided slip form initially rests near the ground, and forms a gap between it and an adjacent "base wall". That is, wet concrete is introduced between the one-sided slip form and an existent base wall (which may be a pre-existent wall, gravel or sand embankment, etc.). Then, as the concrete is introduced into the gap between the form and base wall (the area where the concrete wall is being formed), the one-sided slip form is moved upward. The upward (vertical or substantially vertical) movement can be performed continuously, periodically, randomly, in steps, or in any other manner desired, so that a concrete wall is extruded, or left in the wake of the one-sided slip form. Optimally, the vertical height of the one-sided slip form is minimal, as greater height result in greater form to wet concrete wall surface areas, which creates: more friction and makes the extrusion process more difficult as the one-sided form is moved upward. For example, if a thirty (30) foot high wall is to be constructed, and the wall is to be 120 feet in length, a one-sided form fourteen inches (14") in height is sufficient. In constructing such a wall, the one-sided slip forms (depending on the length of each form, a number of forms placed end to end next to each other, each with its own set of vertical support posts, are required to construct a 120 foot wall) are initially positioned near or at the ground level (for example, twelve 10 foot long forms can be placed next to each other to yield a 120' wall). About 4" of concrete is placed into the gap between the one-sided slip form and the base wall, and the one-sided slip form is then moved upward about 4" at a time, as concrete is laid out in a bead from one end of the 120 foot wall to the opposite end. Because of the problems associated with positioning cement trucks or concrete mixers immediately adjacent to the area where the concrete wall is to be formed (for example, a concrete mixer or truck may cause loose gravel to fall over the rim of a gravel embankment into the forming area, resulting in impurities within the formed concrete wall), and because the rate of concrete delivery must be controllable with respect to the raising of the form, a concrete pumping system or otherwise mechanized concrete delivery system must be utilized according to the present invention. When the concrete has been laid out (with the use of concrete pumped through a hose) along the entire length of the one-sided slip form, the form is continuously moved upward in 4" increments until the wall is, for example, 30 feet high. In effect, the one-sided form performs an extrusion process, by pressing the freshly poured concrete against the base wall. By exposing 4" of the poured concrete to the air at a time, the concrete settles and dries at rates not attainable by the prior art. For example, according to the present invention, 30" of wall can be poured in about an hour. Of course, other variables can be adjusted to optimize the process described above, for example, using hot water to mix the concrete in colder temperatures, adjusting the coarseness of the gravel used in the concrete, the cement to water ratio, etc.

The present invention leads to markedly more efficient and effective concrete wall construction, since only a single form mechanism need be assembled. Also, since the vertical height of the single sliding form is always small in comparison to the height of the wall to be constructed, construction costs are reduced, as less wood is required and no plywood is required at all. The only form required can be, for example, a 3" by 14" by 80" plank of wood. The prior art typically used forms of at least 30" in height. By using forms with so much surface area in common with freshly poured wet concrete, friction complicates the wall formation process because of the tremendous friction between the sliding form and the wet concrete. Also, a great deal more force is required just to set the slip form into upward motion, all but ruling out the use of non-mechanized devices to raise the forms. Of course, by eliminating one side of the conventional two-sided form entirely, the effects of friction are already reduced by the present invention, but also, the minimal height of the sliding form of the present invention is tremendously advantageous.

The present invention uses substantially narrower forms, and in turn, the form is moved vertically upward quicker (and in a greater number of steps) than is conventionally used in the prior art. By adding extra vertical steps in the formation of concrete walls, greater concrete strength for the overall wall is achieved, since each individual layer of poured concrete is thinner and the concrete drys quicker and with greater strength, and the individually poured layers mate better with each other. That is, a more homogeneous concrete mixture is obtained, drying to form a stronger and more durable concrete wall. To facilitate the settling process (so that the individually poured layers mate well with each other), a so-called "pencil vibrator" is drawn through each of the newly deposited layers after they are poured, so each layer immediately bonds to the layer beneath it, and any air pockets contained within the concrete are eliminated.

Because each concrete layer is deposited into such a shallow gap, and because the form is moved upward so quickly, the present invention required the use of a mechanized concrete delivery system, such as concrete pumped through a hose that can be drawn through the entire length of the gap between the one-sided slip form and the base wall. The present invention also relies somewhat on the use of a constant volume output concrete pumping mechanism to deliver relatively thin layers of concrete, one layer at a time, to the gap between the one-sided slip form and the base wall. The concrete should optimally be delivered via a hose which fits within the gap between the form and the base wall. The deposited layers of concrete may, for example, be on the order of 4" in depth, and have a width equal to the gap between the form and the base wall. Each layer is poured across the entire length of the concrete form. By using a concrete pump, the concrete may be poured in uniformly thick layers and at a rate substantially fast enough so that the one-sided slip form can be lifted upward (leaving a concrete wall in its wake) at drastically higher rates.

Other aspects of concrete wall forming can be modified to facilitate the use of the present invention with superior results. Typically, iron rods (or rebar) are placed within the concrete wall close to its interface with the slip-form, thus adding to the overall strength of the concrete wall. Also, because concrete must be pumped layer by layer into the gap behind the one-sided form, it is crucial that the mixture of cement and gravel be adjusted accordingly. For example, whereas traditionally, 4.5 to 5.5 100-pound bags of cement are used per cubic yard or "yard" of concrete required, 6 bags of cement are used, to "richen" the mix, or decrease the amount of water in each yard of concrete. Because the height of the form is minimized according to the present invention, too much water could impede the wall extrusion rate. Also, finer gravel, on the order of ¼" in diameter or so called "pea gravel", instead of the traditional ¾" diameter gravel is preferably used according to the present invention. By changing the consistency of the concrete, it can be pumped at a rate that allows the one-sided slip form to be used with maximum efficiency. Of course, additives, such as DURASET®, a setting accelerator can be used to hasten the setting of the concrete. As the exterior of the newly poured concrete wall is exposed when the one-sided form is raised (for example, at 4" at a time), the concrete exposed to air (4" at a time) immediately forms a sort of "crust" around the surface of the extruded concrete wall. This crust serves to hold back the wet concrete still contained within the interior of the freshly poured wall, to maintain the shape of the substantially vertical wall. By substantially vertical, it is intended that the present invention be primarily used to construct walls that are perpendicular or nearly perpendicular to the ground.

By following the description of the invention set forth above, concrete walls of superior strength can be constructed in drastically reduced times. Test results have shown that traditional concrete walls can support 4,000 lbs. per square inch (PSI), whereas a concrete wall made with the present invention can often withstand pressures of 6,000 PSI. And in addition, this enhanced strength is accomplished in less time than with the prior art.

DETAILED DESCRIPTION OF THE PREFERRED EMBODIMENT

Figure 1:
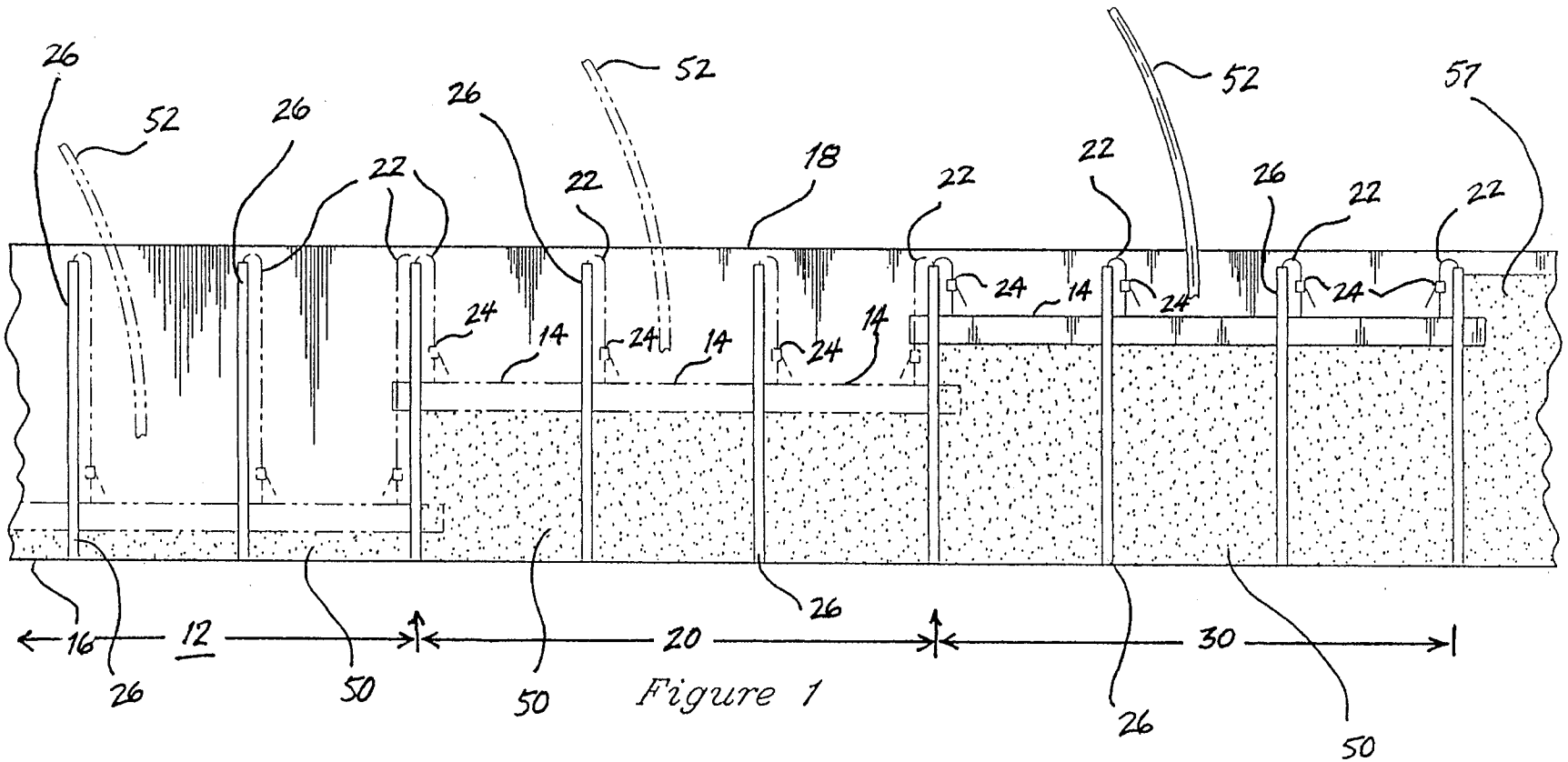
FIG. 1 is an overall diagram of the present invention which, from left to right, shows the construction (or extrusion) of a vertical concrete wall by three separate forms placed end to end according to the present invention.

FIG. 1 shows an overall view of a concrete wall 50 being poured via hose 52, at three positions or segments from left to right, labelled 12, 20 and 30 respectively. That is, to construct a wall 50 of any desired length, a number of forms 14 may be placed next to each other, end to end, to obtain the desired length. As shown, the three wall segments 12, 20 and 30 are being added to concrete wall 57, which was previously poured and formed to its full height. At segment 12, the one-sided form 14 is shown nearest the ground 16. Hose 52 is moved from one end of the single sided slip-form 14 to the other so that a layer of concrete 50 is deposited behind it. That is, the concrete 50 is deposited into the gap 62 (shown in FIG. 2) between base wall 18 and form 14. At segment 20, the form 14 has been raised by cables 22 to a height equal to approximately ½ of the wall to be constructed. Winches 24 are used to raise the one-sided slip form 14 vertically upward as more concrete 50 is pumped through hose 52 and into gap 62. Optimally, form 14 is raised as quickly as possible, leaving behind a wall in its wake. This can be characterized as a concrete extrusion process, with form 14 serving to extrude the concrete up along the base wall 18. Cables 22 are attached to support posts 26, which are supported by footing 28 (shown in FIG. 2). Support posts 26 may also be fastened at their top ends to the base wall 18 and at their bottoms to the footing 28 by lateral supports well known in the art (not shown). At segment 30, the concrete wall 50 is shown to be nearly completed. At that point, the slip form 14 has been vertically raised to its maximum height by winches 24 along cables 22. In the case where the wall segments 12, 20 and 30 start out (at their bottoms) at unequal levels (for example, the footing 28 is a series of tiers or steps), the forms 14 for each respective segment 12, 20 and 30 will each commence being raised at different times, in the order where the lowest level wall segment form 14 starts upward first, until it reaches the height of the second highest form 14, and so on, until all three forms 14 (at segments 12, 20 and 30) can be raised together to the same final height.

Figure 2:
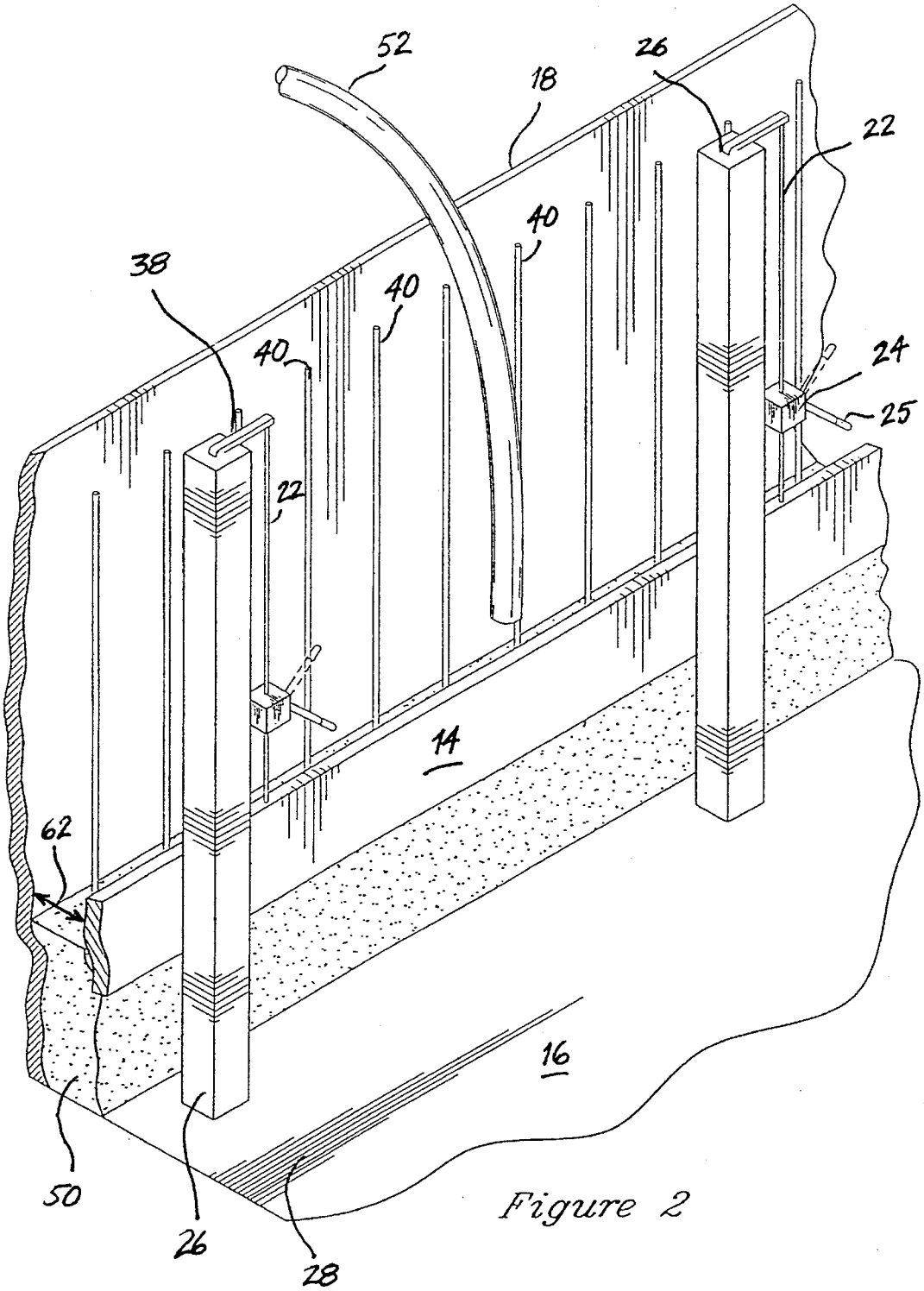
FIG. 2 is a detailed diagram of the initial set-up of the present invention to form a concrete wall.

In FIG. 2, the concrete wall 50 at segment 12 of FIG. 1 is shown. The form 14 and associated hardware are shown in greater detail to illustrate the forming system of the present invention. The concrete forming system of the present invention functions to produce concrete walls 50 of superior strength and in drastically reduced production times. Upon and/or within the ground 16, a footing 28 is prepared to support post supports 26. The support posts 26 can be 6" by 6" high pressure wooden timbers, capable of remarkable strength and sufficient in length to allow a concrete wall 50 of any desired height to be constructed. That is, the supports 26 must be at least as high as the desired height of the wall 50 to be constructed, and preferably should not exceed the height of the available base wall 18. If the supports 26 exceed the length of the base wall 18, stops (not shown) should be placed on the supports 26 to stop form 14 before it can be raised above the height of the base wall 18. If not, the form 14 may be left to sway out of the vertical plane. Attached to the support posts 26 are cables 22 which are fastened to the supports 26 by way of cable attachment hooks 38. Cables 22 are connected to winches 24, which can be common "come along" winches with handles 25, so that the form 14 can be raised by activating the winches 24. Of course, any manual or mechanized transit device, such as a motor, linear actuator, screw jack, or the like, can be used instead of winches 24. With the present invention, the form 14 can be raised in 4" increments by activating winches 24. Form 14 can consist of a 3" by 14" plank of wood, sufficient in length to construct a concrete wall 50 of desired width. Form 14 should possess sufficient tensile strength to contain wet concrete 50 within gap 62, although the relatively minimal height of form 14 (for example, about 14") minimizes the amount of wet concrete that must be contained at any given instant in time, and in turn, minimizes the strength required by form 14 to hold the poured concrete 50. The thickness of the concrete wall 50 is established by setting the gap 62 between the form 14 and the base wall 18. Because the present invention uses a single form 14 (a one-sided form) for constructing walls 50, the wall 50 is pressed and formed up against base wall 18, which may be a dirt or gravel wall, tunnel lagging, embankment or any other vertical or substantially vertical structure, wall or surface. Thus, a major shortcoming of the prior art is overcome because there is no need to construct one concrete wall and bolt it to another—the present invention allows the formation of a concrete wall 50 directly against an existent base wall 18, which can be any preexistent substantially vertical structure. The technique of the present invention also helps prevent water leakage that can result from driving bolts through two adjacent concrete walls—whereby water can seep through the bolt holes.

Rebar or other reinforcing member 40 is placed within the poured concrete wall 50 and is ideally located closer to the form 14 than to the base wall 18. In this manner, the strength of the resulting concrete wall 50 is enhanced.

It is preferable to lay the wet concrete 50 down into gap 62 in layers along the length of form 14. The thickness of these layers should be less than ½ of the height of the form 14. Although traditional forms 14 have often had a height of nearly 3' or more, the form 14 of the present invention has a significantly reduced height, for example, on the order of 14". In this preferred embodiment, the wet concrete 50 is deposited by hose 52 in 4" layers, across the length of form 14, from one end to the other. As the wet concrete 50 is deposited in these layers, the form 14 is raised in 4" increments by activating winches 24. Then, more wet concrete 50 is poured to fill the gap 62 and the form 14 is raised again, leaving a concrete wall 50 in its wake.

Form 14 cannot be raised too quickly or else the wet concrete 50 will not have had a sufficient time to dry and the concrete wall 50 will slide out from under the form 14. In order to solve this problem and to increase the strength of the concrete wall 50 while reducing the setting time, wet concrete 50 can be modified to facilitate the present invention. Traditionally, wet concrete 50 consists of ¾" diameter gravel, water and 4.5 to 5.5 100-pound bags of cement. It is critical that enough water be used to allow the wet concrete 50 to travel through the hose 52, however, if too much water is used, the resulting concrete wall 50 may never possess the necessary strength. Therefore, according to the present invention, around six (6) 100-pound bags of cement can be used per yard (cubic yard) of wet concrete 50 required. Also, instead of using ¾" diameter gravel, ¼" diameter gravel or "pea gravel" can be used to facilitate the flow of wet concrete 50 through hose 52.

A pencil vibrator (not shown in the Figures), well known in the art, is used to vibrate each layer of wet concrete 50 as the concrete is deposited. The pencil vibrator is dragged along the length of the layer of wet concrete 50 and as concrete is deposited by hose 52 along the length of the gap 62 behind the form 14, the vibrator follows behind the hose 52 to promote mating between the poured concrete layers to each other and to eliminate air pockets that may exist. All of the foregoing steps promote the formation of stronger concrete walls 50.

Figure 3:
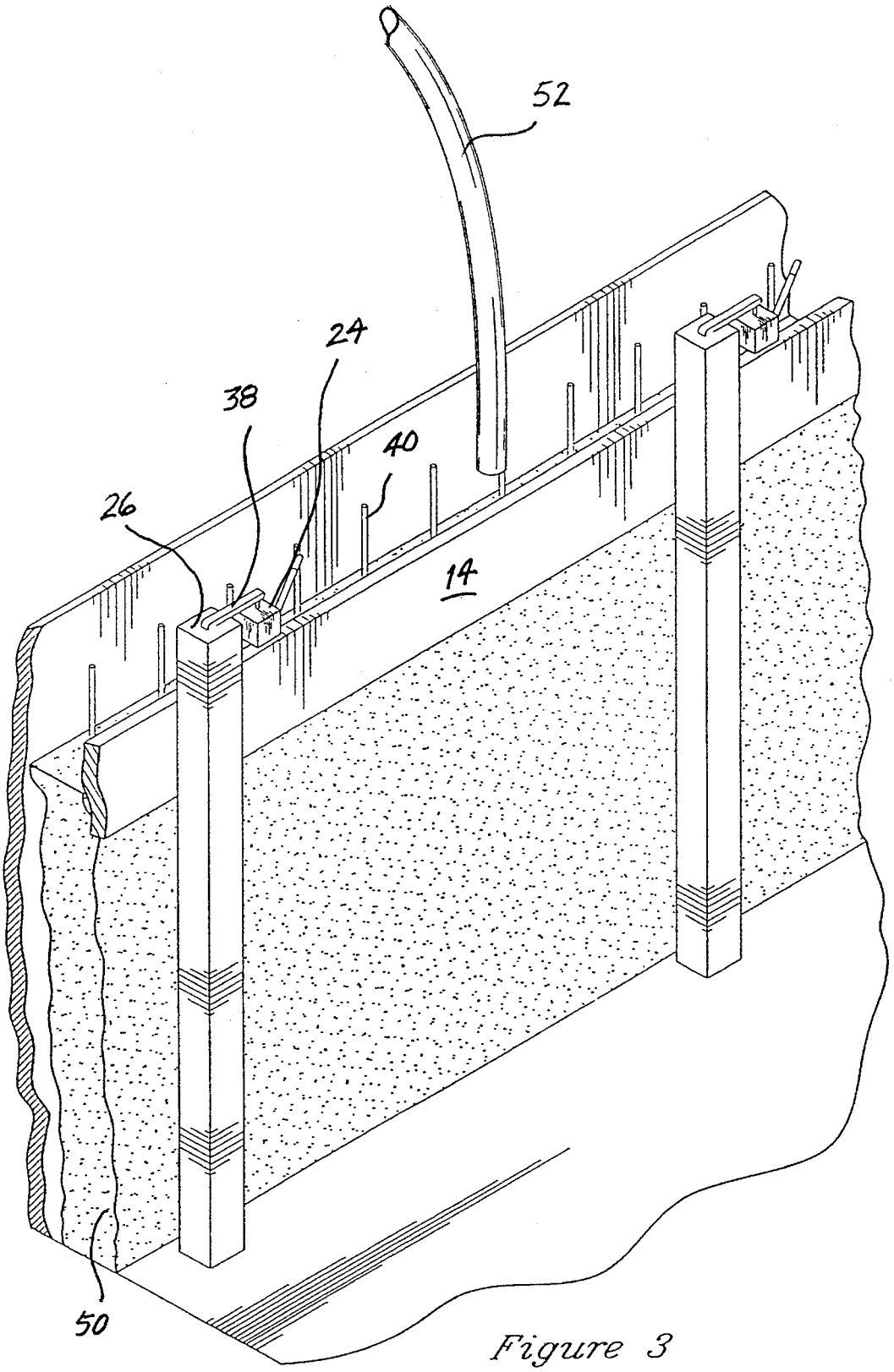
FIG. 3 is a identical to FIG. 2, except that the concrete wall has nearly been completed.

In FIG. 3, which is identical to FIG. 2, a nearly completed concrete wall 50 is shown, as illustrated in FIG. 1 at position 30. The form 14 has been raised to near the top of post supports 26, leaving behind a concrete wall 50 in its wake. In effect, the form 14 extrudes concrete wall 50 upward along base wall 18.

Figure 4:
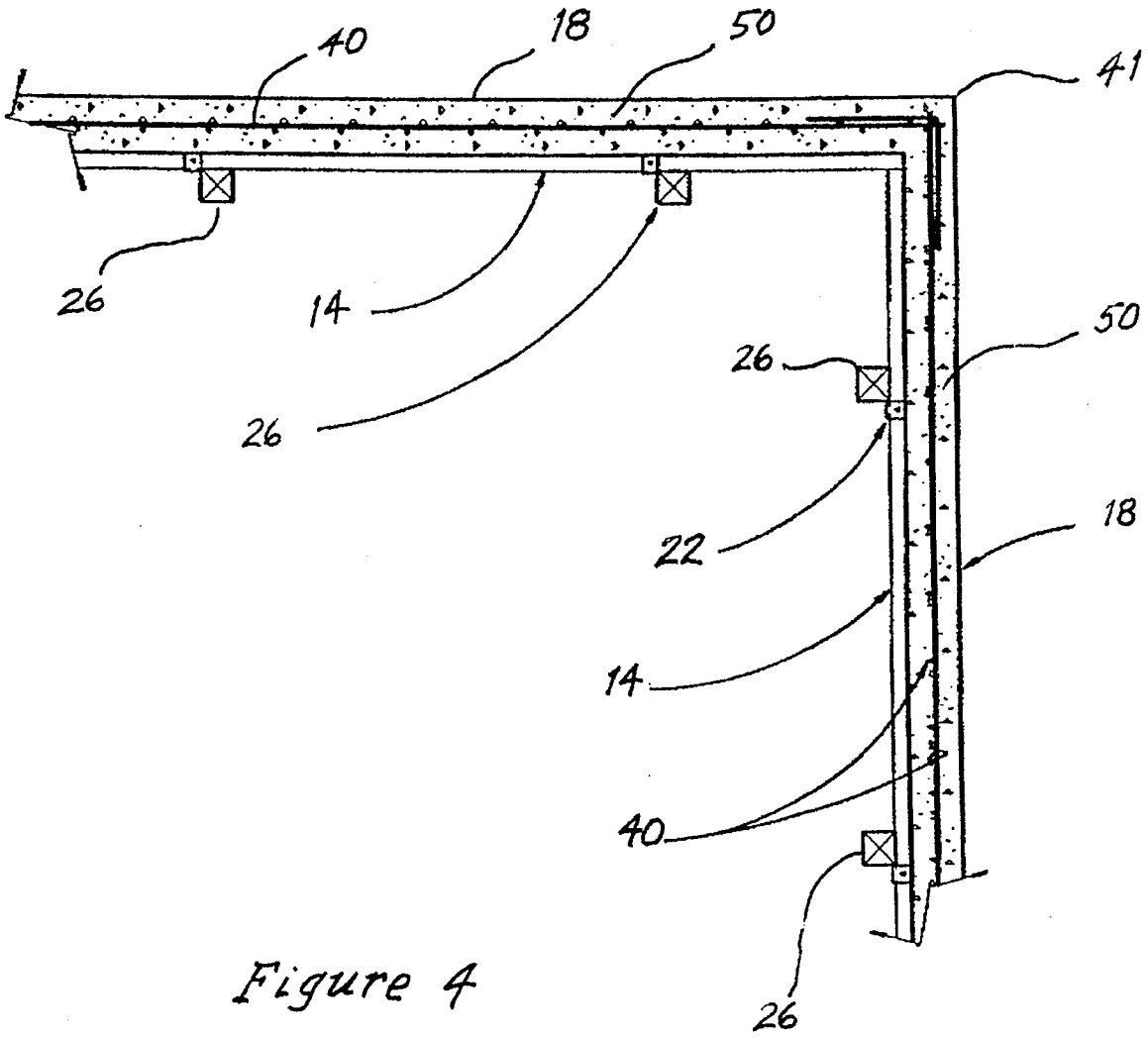
FIG. 4 is a top view of a wall corner formed by the present invention.

FIG. 4 is a top view of a wall corner as formed by the present invention. Two forms 14 are positioned to form a right angle between them, although the forms 14 can be positioned at any angle with respect to each other desired. Vertically positioned support posts 26 support forms 14 by way of cables and supporting hardware 22, so that the forms 14 can be raised from the bottom to the top of a wall 50 to be formed. Wall 50, typically made of concrete (although any other formable material can be used), is poured and both forms 14 are raised until both walls 50 (that is, each wall 50 at a right angle to the other) are formed or extruded to the desired height. When the walls 50 have dried, the resulting wall is as shown in FIG. 4, whereby the walls 50 dry to form a right angle. Rebar 40 (or internal supporting member 40, which may be of any suitable material) is imbedded within walls 50 to provide support, and extra supporting members or rebar 41 can be placed at the corner of the wall 50 to provide necessary strength.

Figure 5:
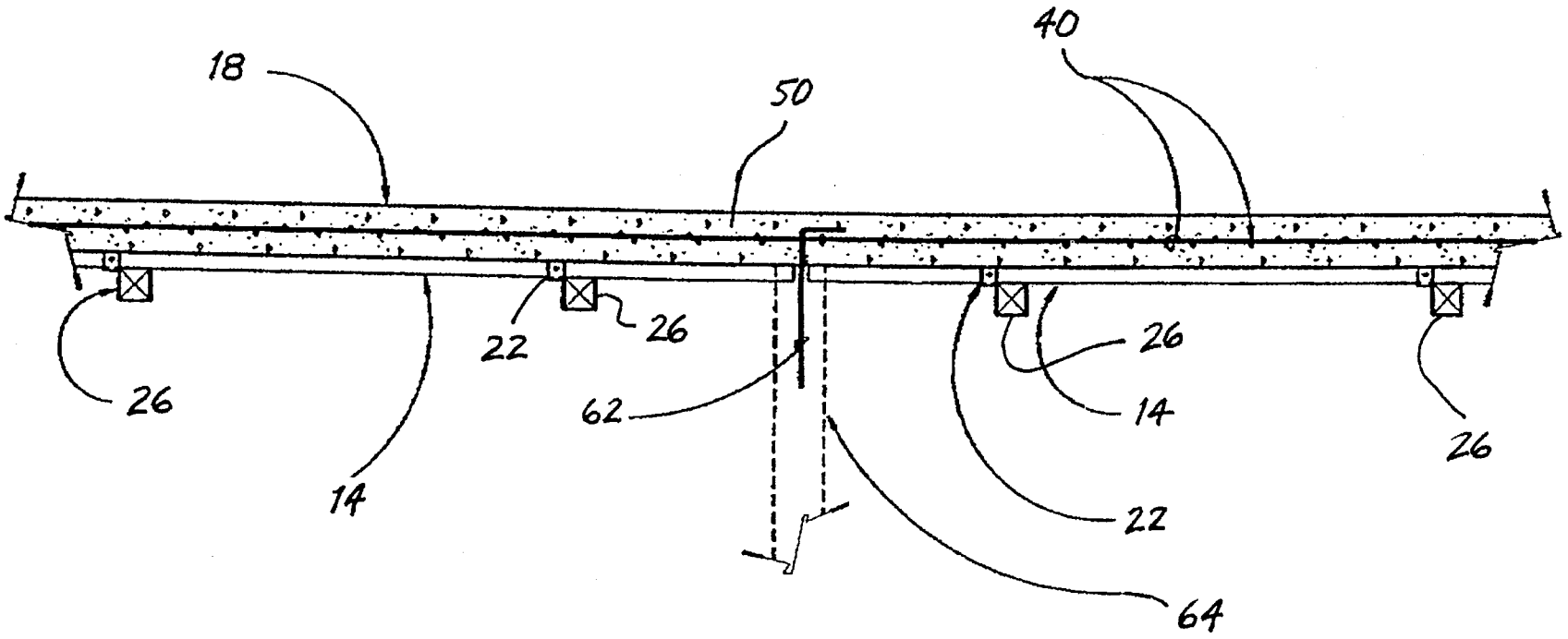
FIG. 5 is a top view which shows an interior wall supported by a wall formed by the present invention.

FIG. 5 is a top view of the present invention which shows an internal wall 64 held in place by concrete wall 50 formed according to the present invention. Supplemental support rods or rebar 62, held in place by concrete wall 50 and other support rods or rebar 40, mate with interior wall 64 to hold it in place. Vertically positioned support posts 26 and cables. (and associated mounting hardware) 22 enable forms 14 to be raised to form walls 50 on each side of the supplemental support rods 62. As the formed walls 50 (one portion of the wall 50 formed by each form 14) are extruded by forms 14, the two wall 50 portions are fused together around the supplemental support member 62, which is then permanently held in place when the concrete 50 settles and dries.

Naturally, the invention is not limited to the above described examples of the process or to the illustrated and explained embodiments of the apparatus. Alternatives to the apparatus and method described herein would be immediately apparent to those of skill in the art. Such alternatives are intended to be included within the scope defined by the claims.

What I claim is:

1. An apparatus for forming by extrusion a concrete wall of predetermined thickness, height, and length, said apparatus comprising:

two or more substantially vertical support means positioned at a distance from a preexisting member which distance represents said predetermined thickness of said concrete wall, at least one slip forming means disposed horizontally between said support means and said preexisting member, said slip forming means having a vertical dimension substantially less than its horizontal dimension and substantially less than said predetermined height of said concrete wall, and said slip forming means serving to extrude concrete up against said preexisting member by pressing said concrete against said preexisting member, connector means attaching said slip forming means and said support means such that said forming means is vertically movable along a height of said support means at least up to said predetermined height of said concrete wall, transit means coupled to said connector means for causing said slip forming means to move upwardly along said substantially vertically support means to cause said slip forming means to extrude said concrete up against said preexisting member until said predetermined height of said concrete wall is reached, concrete delivery means positioned between said slip forming means and said preexisting member for sequentially pouring layers of wet concrete between said slip forming means and said preexisting member and along said predetermined length of said concrete wall from a first end of said concrete wall to a second end of said concrete wall, and movable vibrating means for sequentially consolidating each of said poured layers of concrete layers and for causing bonding of each last poured layer of concrete with a previously last poured layer of concrete positioned immediately thereunder.

2. An apparatus according to claim 1 wherein said slip forming means has a vertical dimension of about 14 inches.

3. An apparatus according to claim 1 wherein said transit means is a fuel burning engine.

4. An apparatus according to claim 1 wherein said transit means is an electric motor.

5. An apparatus according to claim 1 wherein said slip forming means is a wooden plank.

6. An apparatus according to claim 1 wherein said concrete delivery means comprises a pump.

7. An apparatus according to claim 6 wherein said pump supplies concrete between said slip forming means and said preexisting member at an optimum rate.

8. An apparatus according to claim 7 wherein said optimum rate is calibrated according to a density of said concrete.

9. An apparatus for forming by extrusion a substantially vertical concrete wall of predetermined thickness, height, and length comprising:

two or more substantially vertical support members positioned at a distance from a preexisting member which distance represents said predetermined thickness of said concrete wall, a slip forming member disposed between said support members and said preexisting member said slip forming member having a vertical dimension substantially less than its horizontal dimension and substantially less than said predetermined height of said concrete wall, and said slip forming means serving to extrude concrete up against said preexisting member by pressing said concrete against said preexisting member, a connecting member for connecting said support members and said slip forming member, wherein said connecting member permits said slip forming member to vertically travel along a height of said support members at least up to said predetermined height of said concrete wall, a concrete delivery system for sequentially pouring layers of concrete between said slip forming member and said preexisting member up to said predetermined height of said concrete wall, and along said predetermined length of said concrete wall from a first end of said concrete wall to a second end of said concrete wall at a predetermined rate to form said concrete wall of said predetermined thickness, height, and length, and a vibrating member for sequentially consolidating said poured layers of concrete and for causing bonding of adjacent layers of said poured concrete.

10. An apparatus according to claim 9 wherein said concrete delivery system is calibrated to deliver concrete at a rate to permit said slip forming member to be raised at a maximum rate, while still permitting said concrete wall to be formed with adequate strength.

11. An apparatus according to claim 9 wherein said slip forming member has a height of about 14 inches.

* * * * *